US011479736B1

(12) United States Patent
Dingwell et al.

(10) Patent No.: US 11,479,736 B1
(45) Date of Patent: Oct. 25, 2022

(54) LUBRICANT COMPOSITION FOR REDUCED ENGINE SLUDGE

(71) Applicant: Afton Chemical Corporation, Richmond, VA (US)

(72) Inventors: Lisa Dingwell, Midlothian, VA (US); Michael Rosana, Ashland, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/339,286

(22) Filed: Jun. 4, 2021

(51) Int. Cl.

| | |
|---|---|
| ***C10M 169/04*** | (2006.01) |
| ***C10M 155/04*** | (2006.01) |
| ***C10M 157/10*** | (2006.01) |
| ***C10M 133/12*** | (2006.01) |
| ***C10M 129/10*** | (2006.01) |
| ***C10M 137/10*** | (2006.01) |
| ***C10M 135/10*** | (2006.01) |
| ***C10M 141/10*** | (2006.01) |
| ***C10M 167/00*** | (2006.01) |
| ***C10M 149/02*** | (2006.01) |
| *C10N 40/25* | (2006.01) |
| *C10N 30/04* | (2006.01) |
| *C10N 30/10* | (2006.01) |

(52) U.S. Cl.
CPC ..... *C10M 169/048* (2013.01); *C10M 129/10* (2013.01); *C10M 133/12* (2013.01); *C10M 135/10* (2013.01); *C10M 137/10* (2013.01); *C10M 141/10* (2013.01); *C10M 149/02* (2013.01); *C10M 155/04* (2013.01); *C10M 157/10* (2013.01); *C10M 167/00* (2013.01); *C10M 2203/003* (2013.01); *C10M 2207/023* (2013.01); *C10M 2215/26* (2013.01); *C10M 2217/06* (2013.01); *C10M 2219/044* (2013.01); *C10M 2223/045* (2013.01); *C10M 2229/00* (2013.01); *C10N 2030/04* (2013.01); *C10N 2030/10* (2013.01); *C10N 2040/25* (2013.01)

(58) Field of Classification Search
CPC ..... C10M 2207/026; C10M 2207/028; C10M 2207/262; C10M 2215/064; C10M 2215/28; C10M 2215/08; C10M 2219/046; C10M 2223/045; C10M 2227/061; C10N 2040/25; C10N 2060/09
See application file for complete search history.

(56) References Cited

U.S. PATENT DOCUMENTS

| | | | |
|---|---|---|---|
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | Le Suer |

(Continued)

FOREIGN PATENT DOCUMENTS

| | | |
|---|---|---|
| EP | 0612839 | 8/1994 |
| GB | 1065595 A | 4/1967 |

(Continued)

*Primary Examiner* — Vishal V Vasisth
(74) *Attorney, Agent, or Firm* — Honigman LLP

(57) ABSTRACT

The present disclosure describes lubricant compositions effective to minimize average engine sludge through selection of lubricant additives that control the total nitrogen as well as the origin of the nitrogen in the lubricant composition. In aspects, the lubricant compositions herein include at least a base oil of lubricating viscosity, a dispersant system, and at least one antioxidant.

15 Claims, 2 Drawing Sheets

(56) References Cited

U.S. PATENT DOCUMENTS

| | | | |
|---|---|---|---|
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,458,530 | A | 7/1969 | Siegel et al. |
| 3,470,089 | A | 9/1969 | Morris et al. |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,522 | A | 1/1973 | Le Suer |
| 3,749,695 | A | 7/1973 | de Vries |
| 3,859,318 | A | 1/1975 | Lesuer |
| 3,865,740 | A | 2/1975 | Goldschmidt |
| 3,865,813 | A | 2/1975 | Gergel |
| 3,954,639 | A | 5/1976 | Liston |
| 4,152,499 | A | 5/1979 | Boerzel et al. |
| 4,234,435 | A | 11/1980 | Meinhardt et al. |
| 4,259,194 | A | 3/1981 | DeVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | DeVries et al. |
| 4,272,387 | A | 6/1981 | King et al. |
| 4,283,295 | A | 8/1981 | DeVries et al. |
| 4,285,822 | A | 8/1981 | deVries et al. |
| 4,379,064 | A | 4/1983 | Cengel et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,646,860 | A | 3/1987 | Owens et al. |
| 4,647,390 | A | 3/1987 | Buckley, III et al. |
| 4,648,886 | A | 3/1987 | Buckley, III et al. |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,857,214 | A | 8/1989 | Papay et al. |
| 4,948,386 | A | 8/1990 | Sung et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | DeGonia et al. |
| 5,266,223 | A | 11/1993 | Song et al. |
| 5,334,321 | A | 8/1994 | Harrison et al. |
| 5,650,381 | A | 7/1997 | Gatto et al. |
| 5,739,355 | A | 4/1998 | Gateau et al. |
| 6,107,257 | A | 8/2000 | Valcho et al. |
| RE37,363 | E | 9/2001 | Gatto et al. |
| 6,300,291 | B1 | 10/2001 | Hartley et al. |
| 6,548,458 | B2 | 4/2003 | Loper |
| RE38,929 | E | 1/2006 | Gatto et al. |
| 7,214,649 | B2 | 5/2007 | Loper et al. |
| 7,253,231 | B2 | 8/2007 | Devlin et al. |
| RE40,595 | E | 12/2008 | Gatto et al. |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 2015/0344808 | A1* | 12/2015 | Lagona ..... C10M 141/10 508/306 |

FOREIGN PATENT DOCUMENTS

| | | | |
|---|---|---|---|
| GB | 2140811 | A | 12/1984 |
| WO | 9406897 | A1 | 3/1994 |

* cited by examiner

LUBRICANT COMPOSITION FOR REDUCED ENGINE SLUDGE

TECHNICAL FIELD

The present disclosure generally relates to lubricating oil compositions and additives therefor effective for reducing engine sludge.

BACKGROUND

Lubricants intended for use as motor oils (also commonly referred to as engine oils or crankcase oils) in gasoline or diesel automobile engines commonly include a base oil or a blend of base oils of lubricating viscosity and one or more additives to meet certain performance requirements for the intended application. Modern industry standards are placing increasingly stringent requirements in terms composition and performance of such oils, which often leaves little room for lubricant formulation flexibility. As lubricant manufacturers strive to meet various industry standards, it becomes a challenge to cost effectively achieve all the needed performance and industry standards at the same time.

As manufacturers continue to push for improved efficiency and fuel economy, demands on engines, lubricants, and their components continue to increase. More stringent testing and certifications are often required of today's lubricants, and one area of recent focus is an evaluation of the lubricant's role in sludge formation in cylinder head, oil sump, valve covers, and/or timing covers of engines during extended operation. Newer and more stringent engine tests, such as the M271 EVO fired engine test (CEC L-107-19), place heightened demands on lubricants to not only minimize sludge formation, but also adequately suspend sludge in solution to minimize fluid viscosity increases and the associated oil pressure increases at the same time.

SUMMARY AND TERMS

In accordance with one embodiment, a lubricant composition effective to reduce engine sludge pursuant to CEC 107-19 is described herein. In one approach, the lubricant composition includes a base oil of lubricating viscosity and nitrogen provided by a dispersant system and an antioxidant system. In aspects, the dispersant system includes at least one hydrocarbyl substituted succinimide dispersant obtainable by reacting a hydrocarbyl substituted acylating agent with a nitrogen source, and the antioxidant system includes at least one aminic antioxidant. In other aspect, the lubricating compositions have a weight ratio of nitrogen provided by the dispersant system to total nitrogen in the lubricant composition of about 0.6:1 to about 0.85:1, and at least about 75% of the nitrogen provided by the dispersant system is a primary or secondary nitrogen that is not post-reacted.

In other approaches or embodiments, the lubricant composition of the prior paragraph may be combined with optional features or optional embodiments in any combination. Such optional features or optional embodiments include one or more of: further comprising a weight ratio of nitrogen provided by at least one aminic antioxidant of the antioxidant system to the total nitrogen in the lubricant composition of about 0.15:1 to about 0.4:1; and/or further comprising a weight ratio of nitrogen provided by the dispersant system to nitrogen provided by the at least one aminic antioxidant of about 1.8:1 to about 5.3:1; and/or further comprising an average engine sludge of about 7 to about 10 merits pursuant to CEC L-107-19; and/or further including a phosphorus source including one or more phosphorus-containing compounds independently selected from a thiophosphate, a dithiophosphate, a metal phosphate, a metal thiophosphate, a metal di-thiophosphate, a phosphate, a phosphite, a phosphonate, salts thereof, and mixtures thereof, and/or further including a detergent system including at least one metal containing detergent providing up to about 3500 ppm metal to the composition and having a combined total base number of 0 to about 500; and/or wherein hydrocarbyl substituted succinimide dispersant of the dispersant system has a structure of Formula I:

(Formula I)

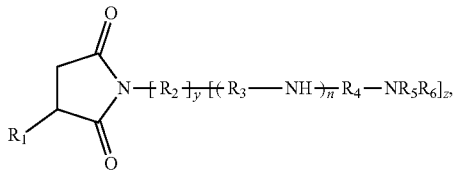

wherein $R_1$ is a hydrocarbyl group having a number average molecular weight of about 350 to about 5,000, and wherein $R_2$, $R_3$, and $R_4$ are independently divalent $C_1$-$C_6$ moieties, and each of $R_5$ and $R_6$, independently, is hydrogen, a $C_1$-$C_6$ alkyl group, or together with the nitrogen to which they are attached form a 5- or 6-membered ring optionally fused with one or more aromatic or non-aromatic rings, and n is an integer from 0 to 8, and y and z are each integers and wherein y+z=1; and/or wherein $R_5$ and $R_6$ together with the nitrogen to which they are attached form a radical of Formula II (Formula II)

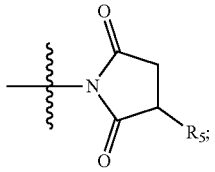

and/or wherein the acylating agent is maleic anhydride; the nitrogen source is a polyalkylene polyamine selected from a mixture of polyethylene polyamines having an average of 5 nitrogen atoms, diethylene triamine, triethylene tetramine, tetraethylene pentamine, pentaethylene hexamine, or combinations thereof; and the hydrocarbyl substituent has a number average molecular weight of about 1000 to about 2,500; and/or wherein the dispersant system includes at least two hydrocarbyl substituted succinimide dispersants and only one of the hydrocarbyl substituted succinimide dispersants is post-treated with a boron source and/or maleic anhydride; and/or wherein the dispersant system includes about 2 to about 4 times more of the non-post treated dispersant than the post-treated dispersant; and/or wherein the dispersant systems provides no more than about 300 ppm of total boron to the lubricant composition; and/or wherein the phosphorus source is present in an amount to provide about up to about 900 ppm of phosphorus to the lubricating composition; and/or wherein the one or more phosphorus-containing compounds is independently selected from a metal phosphate, a metal thiophosphate, a metal dithiophosphate, or combinations thereof; and/or wherein the one or more phosphorus-containing compounds is a metal dithiophosphate and includes 12 to 32 total carbon atoms within alkyl groups thereon, wherein each of the alkyl groups independently averages 3 to 8 carbon atoms; and/or wherein the one or more phosphorus-containing compounds include a first metal dithiophosphate with the alkyl groups derived from secondary alcohols and a second metal dithiophosphate with the alkyl groups derived from primary alcohols; and/or wherein the metal of the one or more phosphorus-containing compounds is independently selected from the group consisting of aluminum, lead, tin, molybdenum, manganese, nickel, copper, titanium, tungsten, zirconium, or zinc; and/or wherein at least one antioxidant providing nitrogen to the lubricant composition is an aminic antioxidant selected from an aromatic amine, an alkylated diphenylamine, a phenyl-α-napthylamine, alkylated phenyl-α-naphthylamines, hindered non-aromatic amines, or combinations thereof; and/or wherein the lubricating composition includes a second antioxidant selected from a phenolic antioxidant, a sulfurized olefin, aminic antioxidants, or combinations thereof; and/or wherein the detergent systems include one or more metal containing phenates, sulfur-containing phenates, sulfonates, calixarates, salixarates, salicylates, carboxylic acids, phosphorus acids, mono- and/or di-thiophosphoric acids, alkyl phenols, sulfur coupled alkyl phenol compounds, methylene bridged phenols, or combinations thereof.

In yet other embodiments or approaches, the present disclosure provides for the use of a lubricant composition to reduce engine sludge pursuant to CEC L-107-19 and/or methods of lubricating an engine to reduce engine sludge, and in particular, to achieve an average engine sludge of about 7 to about 10 merits pursuant to CEC L-107-19 using any embodiment of the lubricant composition in the previous two paragraphs.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, sulfonates, and/or phenols.

The term "alkaline earth metal" relates to calcium, barium, magnesium, and strontium, and the term "alkali metal" refers to lithium, sodium, potassium, rubidium, and cesium.

As used herein, the term "hydrocarbyl" or "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896.

The term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

As used herein, "post-reacted" or "post-treated" refers to a component that is further reacted with or treated with, for example, a boron, phosphorus, and/or maleic anhydride and may refer to dispersants in which primary and/or secondary amines are further reacted with such compounds to convert at least a portion of such amines to tertiary amines. Such subsequent reactions or treatments are further described in U.S. Pat. No. 5,241,003, which is incorporated herein by reference. Conversely, components that are "not post-reacted" or "not post-treated" have not been subjected to such further processing, reactions, and/or treatments and, in the context of dispersants, include a certain amount of primary and/or secondary amines.

The molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

Additional details and advantages of the disclosure will be set forth in part in the description that follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF DRAWING FIGURES

DETAILED DESCRIPTION

Figure 1:
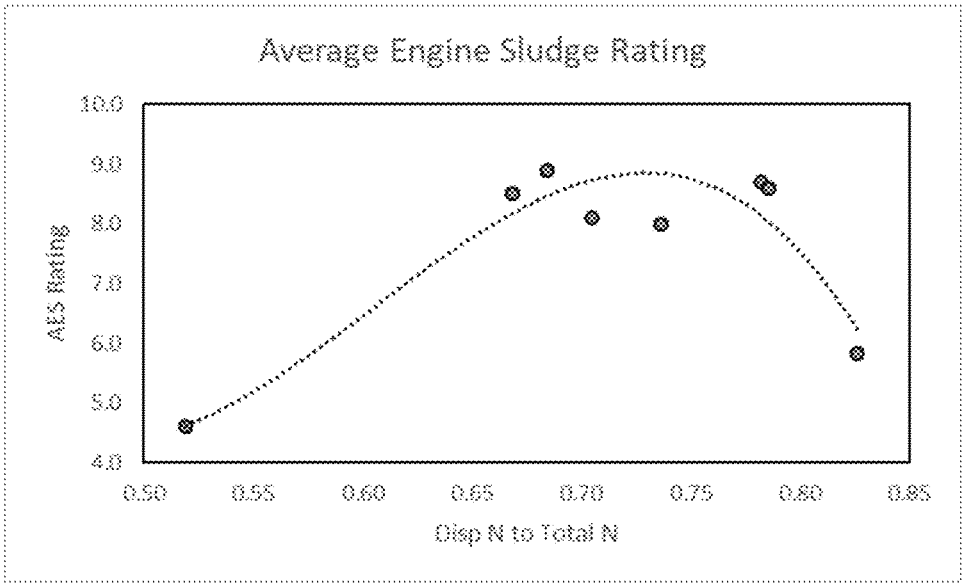
FIG. 1 is a plot of Average Engine Sludge (AES) relative to a weight ratio of dispersant nitrogen to total lubricant nitrogen.

Engine or crankcase lubricant compositions are commonly used in vehicles containing spark ignition or compression ignition engines to provide friction reduction and other benefits. Such engines may be used in automotive, truck, motorcycle, and/or train applications to suggest but a few applications and may be operated on fuels including, but not limited to, gasoline, diesel, alcohol, bio-fuels, compressed natural gas, and the like. These engines may include hybrid-electric engines that include both an internal combustion engine and an electric or battery power source and/or advanced hybrid or internal combustion engines that include an automatic engine stop functionality when a vehicle is at rest. The lubricant compositions herein are effective to minimize sludge formation and/or improve sludge suspension in the lubricant for such engines leading to improved fluid viscosities and/or limited oil pressure increases due to engine sludge.

In one approach or embodiment, the present disclosure describes unique lubricant compositions effective to minimize average engine sludge (AES) in the M271 EVO fired engine test (CEC L-107-19) through selection of lubricant additives that control the total nitrogen as well as the origin of the nitrogen in the lubricant composition. In aspects, the lubricant compositions herein include at least a base oil of lubricating viscosity, a dispersant system, and at least one antioxidant that include unique relationships with respect to the nitrogen they provide the compositions. The dispersant system provides one source of nitrogen and includes at least one hydrocarbyl substituted succinimide dispersant obtainable by reacting a hydrocarbyl substituted acylating agent with a nitrogen source. The at least one antioxidant also provides a source of nitrogen and may also include non-aminic antioxidants, such as phenolic antioxidants, as needed for a particular application. In other approaches, the lubricant compositions herein may also include an optional detergent system including at least one metal containing detergent providing up to about 3500 ppm metal to the composition (and in other approaches, up to about 2500 ppm metal) and having a total base number of 0 to about 150. The lubricant compositions may also include an optional phosphorus source, which may be one or more phosphorus-containing compounds independently selected from a thiophosphate, a dithiophosphate, a metal phosphate, a metal thiophosphate, a metal di-thiophosphate, a phosphate, a phosphite, a phosphonate, salts thereof, and mixtures thereof.

With such componentry, the lubricant compositions herein control the amount and origin of the nitrogen within the fluids. For instance and in one approach, the lubricant compositions have a weight ratio of nitrogen provided by the dispersant system to total nitrogen in the lubricant composition of about 0.6:1 to about 0.8:1. In other approaches, the lubricant compositions may also have at least about 75% of the nitrogen provided by the dispersant system as a primary or secondary nitrogen that is not post-reacted. In yet other approaches, the lubricant compositions may also have a weight ratio of nitrogen provided by the at least one antioxidant to the total nitrogen in the lubricant composition of about 0.15:1 to about 0.36:1, and/or in some formulations the compositions also have a weight ratio of nitrogen provided by the dispersant system to nitrogen provided by the at least one antioxidant of about 1.8:1 to about 5.2:1. Fluids having the above described componentry and also meeting such nitrogen amounts and origin relationships surprisingly achieved high sludge control in the demanding M271 EVO fired engine test. Unexpectedly and as shown in FIGS. 1 to 4, these unique formulation relationships on the amounts and sources of nitrogen exhibit both a minimum and maximum effect relating to sludge control in the M271 EVO testing where average sludge performance was poor at lower ratios but, unexpectedly, also exhibited poor performance after reaching a maximum amount of each noted nitrogen relationship. Uniquely, the fluids herein are effective to achieve an average engine sludge (AES) rating of 7 or higher (and in other approaches, a rating of 7 to 10), and preferably, a rating of 8 or higher (or a rating of 8 to 10) at the conclusion of the M271 fired engine test pursuant to CEC L-107-19.

Turning to the components, the lubricating compositions herein first include a dispersant system providing a source of nitrogen and, in approaches, includes at least one and, in some instances, at least two hydrocarbyl substituted succinimide dispersants obtainable by reacting a hydrocarbyl substituted acylating agent with a nitrogen source, such as various polyalkylene polyamines as discussed more below.

In approaches, the dispersant system may include oil-soluble ashless dispersants selected from the group comprising or consisting of succinimide dispersants, succinic ester dispersants, and/or succinic ester-amide dispersants. While the dispersants may be post-reacted with various molecules capable of reacting with primary or secondary amino groups, at least about 75 percent or more of the nitrogen in the dispersant system is exposed primary or secondary amine that is not post-reacted. In approaches, the lubricating compositions herein may include about 1 to about 8 weight percent of the dispersants herein, and in other approaches, about 2.5 to about 5.5 weight percent (or any other ranges within such endpoints).

Hydrocarbyl-dicarboxylic acid or anhydrides reacted with a nitrogen source, such as polyalkylene polyamines, are used to make succinimide dispersants. Succinimide dispersants and their preparation are disclosed in U.S. Pat. Nos. 7,897,696 and 4,234,435, which are incorporated herein by reference. The hydrocarbyl moiety of the hydrocarbyl-dicarboxylic acid or anhydride of may be derived from polyolefin-based polymers, such as but not limited to butene polymers, for example polymers of isobutylene. Suitable polyisobutenes for use herein include those formed from conventional polyisobutylene or highly reactive polyisobutylene having at least about 60%, such as about 70% to about 90% and above, terminal vinylidene content. Suitable polyisobutenes may include those prepared using $BF_3$ catalysts.

The number average molecular weight of the hydrocarbyl substitutent (such as a polyisobutylene substituent) of the dispersants herein may vary over a wide range, for example, from about 500 to about 5000 (in other approaches, about 1000 to about 3000), as determined by gel permeation chromatography (GPC) using polystyrene (with a number average molecular weight of 180 to about 18,000) as the calibration reference. In one approach, the dispersant system includes a first dispersant having a polyisobutylene substituent with a number average molecular weight of greater than 1900, such as about 2000 to about 5000, and a second dispersant having a polyisobutylene substituent with a number average molecular weight of less than about 1900, such as about 1000 to about 1800. The polyisobutylene moiety in dispersants preferably have a molecular weight distribution (MWD), also referred to as polydispersity, as determined by the ratio of weight average molecular weight (Mw) to number average molecular weight (Mn). Polymers having a Mw/Mn of less than about 2.2, preferably less than about 2.0, are most desirable. Suitable polyisobutylene substituents have a polydispersity of from about 1.5 to about 2.1, or from about 1.6 to about 1.8.

The dicarboxylic acid or anhydride of the dispersants may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of dicarboxylic acid or anhydride to hydrocarbyl moiety in a reaction mixture used to make the hydrocarbyl-dicarboxylic acid or anhydride may vary widely. Accordingly, the mole ratio may vary from about 5:1 to about 1:5, for example from about 3:1 to about 1:3. A particularly suitable molar ratio of acid or anhydride to hydrocarbyl moiety is from about 1:1 to about 2.0:1. Another useful molar ratio of dicarboxylic acid or anhydride to hydrocarbyl moiety is about 1.3:1 to about 1.8:1.

Any of numerous polyalkylene polyamines can be used as in preparing the dispersant additives of the systems herein. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. The molar ratio of hydrocarbyl-dicarboxylic acid or anhydrides to polyalkylene polyamines may be from about 1:1 to about 3.0:1.

In one embodiment, the dispersants may be the reaction product of a polyisobutenyl succinic anhydride (PIBSA), and a polyamine, for example polyethylene amines such as tetraethylene pentamine or various heavy polyamines. The dispersants herein may have a molar ratio of the polyisobutenyl-substituted succinic anhydride to polyamine in the range of 4:3 to 1:10.

In some instances, the dispersants herein may be optionally borated, phosphorylated, or post-reacted with various agents such as maleic anhydride so long as the dispersants meet the nitrogen requirements noted above. These dispersants are generally the reaction products of at least one phosphorus compound, a boron compound, and/or maleic anhydride and the at least one ashless dispersant as described above.

If used, suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

If used, suitable phosphorus compounds for forming the dispersants include phosphorus compounds or mixtures of phosphorus compounds capable of introducing a phosphorus-containing species into the dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithio-phosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary". $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable are the halo-phosphine halides (e.g., hydrocarbyl phosphorus tetrahalides, dihydrocarbyl phosphorus trihalides, and trihydrocarbyl phosphorus dihalides), and the halophosphines (monohalo-phosphines and dihalophosphines).

As noted above and in some embodiments, the dispersant system of the lubricating compositions herein may include at least two dispersants, one obtained from a polyisobutylene having a relatively high number average molecular weight of about 1900 or above (or about 2000 to about 5000 or about 2000 to about 3000) and the other obtained from a polyisobutylene having a relatively lower number average molecular weight of less than about 1900 (or about 1000 to about 1900 or about 1000 to about 1800). In some approaches, the dispersant with the lower molecular weight substituent may optionally be post-treated with a boron source such as boric acid and/or maleic anhydride. In such instances, the dispersant systems may then include about 2 to about 4 times more of the non-post treated dispersant than the post-treated dispersant in the dispersant system and/or the dispersant systems may provide no more than about 300 ppm of total boron to the lubricant composition, no more than about 250 ppm of total boron, no more than about 150 ppm of total boron, no more than about 120 and, in some instances, about 50 to about 200 ppm total boron on any other range therein.

In yet other approaches, the hydrocarbyl substituted succinimide dispersant of the dispersant systems herein may each have a structure of Formula I.

(Formula I)

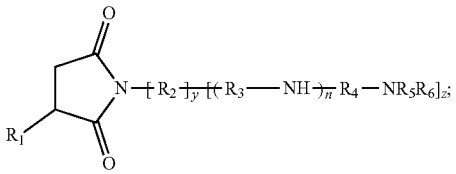

wherein $R_1$ is the hydrocarbyl substituent having a number average molecular weight of about 350 to about 5,000 (or those previously described); $R_2$, $R_3$, and $R_4$ are independently divalent $C_1$-$C_6$ moieties; each of $R_5$ and $R_6$, independently, is hydrogen, a $C_1$-$C_6$ alkyl group, or together with the nitrogen to which they are attached form a 5- or 6-membered ring optionally fused with one or more aromatic or non-aromatic rings; n is an integer from 0 to 8; and y and z are each integers and wherein y+z=1. In some approaches, the dispersant is a bis-succinimide where $R_5$ and $R_6$ together with the nitrogen to which they are attached form a radical of Formula II (Formula II)

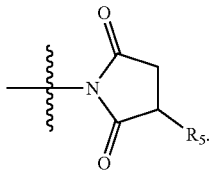

In some approaches, the acylating agent is maleic anhydride and the nitrogen source is a polyalkylene polyamine selected from a mixture of polyethylene polyamines having an average of 5 nitrogen atoms, diethylene triamine, triethylene tetramine, tetraethylene pentamine, pentaethylene hexamine, or combinations thereof; and the hydrocarbyl substituent has a number average molecular weight of about 1000 to about 2,500.

Figure 3:
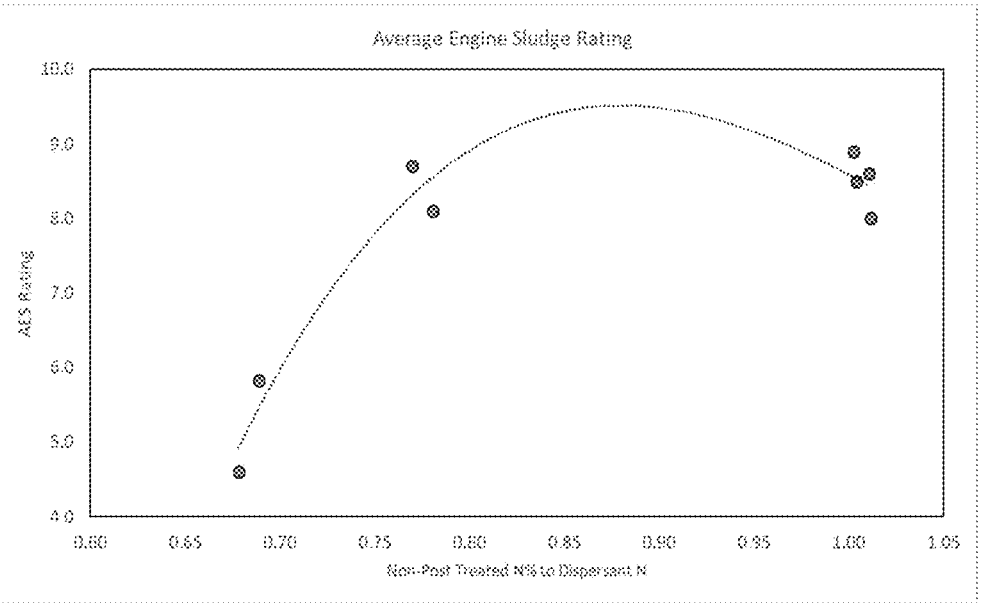
FIG. 3 is a plot of AES relative to a weight ratio of post-reacted nitrogen in the dispersant system.

As noted above, the total nitrogen and source of the nitrogen from the dispersant system aids in achieving the sludge performance of the additives herein with the M271 EVO engine tests. In one embodiment, the compositions have a weight ratio of total nitrogen provided by the dispersant system to total nitrogen in the lubricant composition of about 0.6:1 to about 0.8:1, and in other instances, about 0.62:1 to about 0.81:1, and yet other approaches, about 0.66:1 to about 0.78:1 reflecting the minimum and maximum effects as generally shown in FIG. 1 when achieving desired average engine sludge test results (that is, AES of about 7 or higher or about 8 or higher). At the same time, at least about 75% of the nitrogen (at least about 72%, at least about 75%, or even at least about 80% of the nitrogen) provided by the dispersant system is exposed as a primary or secondary nitrogen and not post-reacted to achieved desired engine sludge performance as generally shown in FIG. 3.

The lubricating compositions herein may also include an optional antiwear system providing a source of phosphorus and, in approaches, includes at least one and in some instances, at least two phosphorus-containing compounds such as metal containing phosphorus-containing compounds and/or ashless phosphorus-containing compounds. The antiwear system provides a mixture of metal and phosphorus-containing compounds effective to achieve, among other features, the friction performance and/or sludge control. The lubricant compositions herein may include about 0.1 to about 2.0 weight percent, and in other approaches, about 0.5 to about 1.5 weight percent of the antiwear system (or other ranges therein) to provide up to about 900 ppm of phosphorus, up to about 800 ppm of phosphorus, or about 50 to about 900 ppm, about 50 to about 800 ppm of phosphorus In approaches, the antiwear system includes a mixture of two or more metal dihydrocarbyl dithiophosphate compounds, such as but not limited to, two or more zinc dihydrocarbyl dithiophosphate compounds (ZDDP). Suitable metal dithiophosphates, such as ZDDP, may include between 5 to about 10 weight percent metal (in other approaches, about 6 to about 9 weight percent metal where the metal is preferably zinc), and about 8 to about 18 weight percent sulfur (in other approaches, about 12 to about 18 weight percent sulfur, or about 8 to about 15 weight percent sulfur). The metal dithiophosphates, such as ZDDP, may also include about 4 to about 15 weight percent phosphorus, and in some approaches, about 6 to about 10 weight percent phosphorus. Suitable metal dihydrocarbyl dithiophosphates may be any of the dihydrocarbyl dithiophosphate metal salts wherein the metal may be an alkali metal, alkaline earth metal, aluminum, lead, tin, molybdenum, manganese, nickel, copper, titanium, zirconium, zinc, or combinations thereof. However, the metal is preferably zinc.

When the phosphorus-containing compounds of the antiwear system is a ZDDP, the alkyl groups on ZDDP may be derived from primary alcohols, secondary alcohols, and/or mixtures thereof. For example, primary alcohols suitable for forming the alkyl groups of the ZDDP include, but are not limited to, ethyl hexyl alcohol, butanol, n-Amyl, and/or C6 and higher primary alcohols. Secondary alcohols suitable for forming the alkyl groups of the ZDDP include, but are not limited to, methyl isobutyl carbinol, isopropyl alcohol, or mixtures thereof. In some cases, the alkyl groups of the ZDDP may be derived from a mixture of primary and secondary alcohols, such as 2-ethyl hexanol (primary), isobutanol (primary), and isopropanol (secondary). For example and in one embodiment, one the ZDDP additives in the antiwear system includes all alkyl groups derived from methyl isobutyl carbinol (secondary alcohol). In other embodiments, a second ZDDP of the antiwear system includes all alkyl groups derived from primary alcohols, such as a 2-ethyl hexanol to the like. In one approach, the antiwear systems herein includes a mixture of metal dialkyl dithiophosphates (preferably zinc dialkyl dithiophosphates) derived from the primary and secondary alcohols. In embodiments, a weight ratio of the primary to the secondary alcohols from the two ZDDP additives combined in the antiwear system is at least 0.75:1 to about 3:1.

Examples of suitable ZDDPs include, but are not limited to: zinc O,O-di($C_{1-14}$-alkyl)dithiophosphate; zinc (mixed O,O-bis(sec-butyl and isooctyl)) dithiophosphate; zinc-O,O-bis(branched and linear $C_{3-8}$-alkyl)dithiophosphate; zinc O,O-bis(2-ethylhexyl)dithiophosphate; zinc O,O-bis(mixed isobutyl and pentyl)dithiophosphate; zinc mixed O,O-bis(1,3-dimethylbutyl and isopropyl)dithiophosphate; zinc O,O-diisooctyl dithiophosphate; zinc O,O-dibutyl dithiophosphate; zinc mixed O,O-bis(2-ethylhexyl and isobutyl and isopropyl)dithiophosphate; zinc O,O-bis(dodecylphenyl)dithiophosphate; zinc O,O-diisodecyl dithiophosphate; zinc O-(6-methylheptyl)-O-(1-methylpropyl)dithiophosphate; zinc O-(2-ethylhexyl)-O-(isobutyl) dithiophosphate; zinc O,O-diisopropyl dithiophosphate; zinc (mixed hexyl and isopropyl) dithiophosphate; zinc (mixed O-(2-ethylhexyl) and O-isopropyl) dithiophosphate; zinc O,O-dioctyl dithiophosphate; zinc O,O-dipentyl dithiophosphate; zinc O-(2-methylbutyl)-O-(2-methylpropyl)dithiophosphate; and zinc O-(3-methylbutyl)-O-(2-methylpropyl)dithiophosphate.

In yet other approaches, each of the phosphorus-containing compounds in the antiwear system herein may each have the structure of Formula III (Formula III)

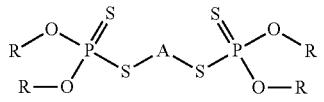

wherein R in Formula I independently contains from 1 to 18 carbon atoms, or 2 to 12 carbon atoms, or about 3 to 8 carbon atoms. The antiwear system may contain two compounds of the structure of Formula I. In each compound, R may be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl as needed to meet the select ratio of primary to secondary alcohols noted above in the antiwear system. In some embodiment, the number of carbon atoms in each R group in Formula I above will generally be about 3 or greater, about 4 or greater, about 6 or greater, or about 8 or greater. Each R group may average 3 to 8 carbons. The total number of carbon atoms in the R groups may be 5 to about 72, or 12 to about 32. In Formula I, A is a metal, such as aluminum, lead, tin, molybdenum, manganese, nickel, copper, titanium, zirconium, zinc, or combinations thereof. Preferably, A is zinc.

In yet other approaches, the zinc dialkyl dithiophosphate of the antiwear system have a sulfur-zinc coordination arrangement of the phosphorus compounds in the antiwear systems shown below the chemical structure of Formula IV, which may used interchangeable with Formula I shown above. It is also understood that the structures shown in Formulas I and II may be present as monomer, dimer, trimer, or oligomer (such as a tetramer).

(Formula IV)

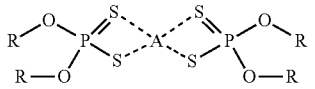

In some embodiments, each phosphorous-containing compound of the antiwear system has the structure of Formula III or IV wherein A is zinc and the combined total of the compounds within the antiwear system provide about 70 to about 800 ppm phosphorus to the lubricant composition (and in other approaches, about 200 to about 800 ppm). As noted above, the antiwear system includes a mixture of zinc dialkyl dithiophosphates. Preferably, the antiwear system may include at least two zinc dialkyl dithiophosphates where a first zinc dialkyl dithiophosphate is derived only from primary alcohols and a second zinc dialkyl dithiophosphate is derived from secondary alcohols.

Dihydrocarbyl dithiophosphate metal salts may be prepared in accordance with known techniques by first forming a dihydrocarbyl dithiophosphoric acid (DDPA), usually by reaction of one or more alcohols or phenols with $P_2S_5$ and then neutralizing the formed DDPA with a metal compound, such as zinc oxide. For example, DDPA may be made by reacting mixtures of primary and secondary alcohols with $P_2S_5$. In this case, the DDPA includes alkyl groups derived from both primary and secondary alcohols. Alternatively, multiple DDPAs can be prepared where the alkyl groups on one DDPA are derived entirely from secondary alcohols and the alkyl groups on another DDPA are derived entirely from primary alcohols. The DDPAs are then blended together to form a mixture of DDPAs having alkyl groups derived from both primary and secondary alcohols.

Figure 2:
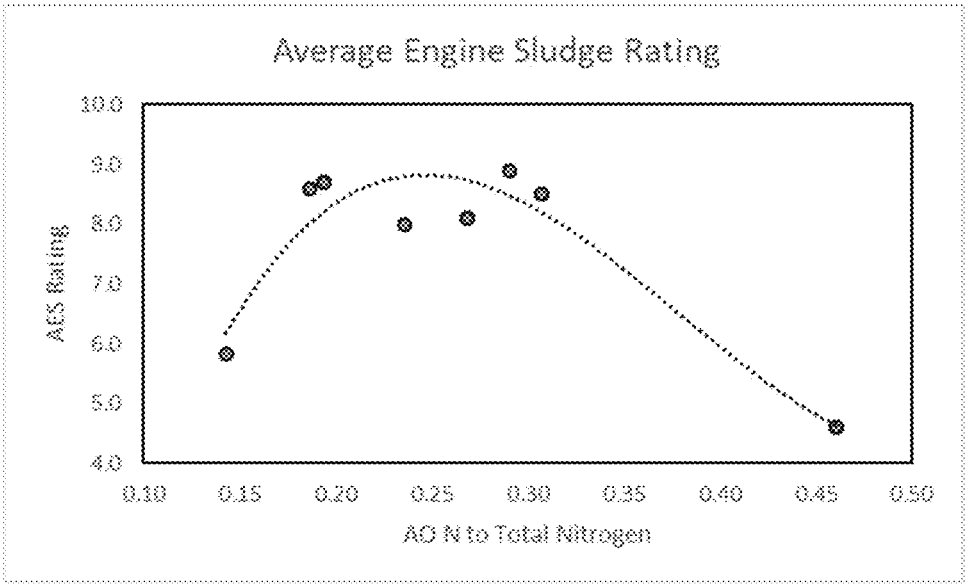
FIG. 2 is a plot of AES relative to a weight ratio of antioxidant nitrogen to total lubricant nitrogen.
Figure 4:
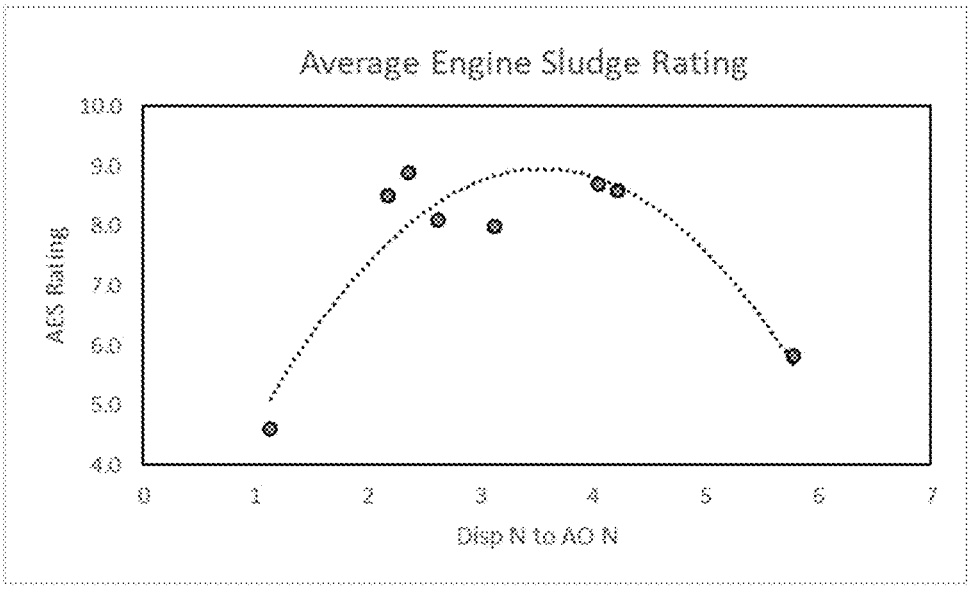
FIG. 4 is a plot of AES relative to a weight ratio of dispersant nitrogen to antioxidant nitrogen.

The lubricating compositions herein also include an antioxidant system also providing a source of nitrogen and, in approaches, includes at least one aminic antioxidant and, in some optional approaches, at least one additional antioxidant. In approaches, the amount of nitrogen from the antioxidant system is also controlled relative to the total nitrogen and/or the dispersant nitrogen to aid in achieving sludge performance. In some approaches, the lubricant compositions herein have a weight ratio of nitrogen provided by the at least one antioxidant to the total nitrogen in the lubricant composition of about 0.15:1 to about 0.4:1, and in yet other approaches, a weight ratio of nitrogen provided by the dispersant system to nitrogen provided by the at least one antioxidant controlled within a ratio of about 1.8:1 to about 5.3:1. As also shown in FIGS. 2 and 4 such relationships also surprisingly show a minimum and maximum effects with sludge control pursuant to the M271 EVO testing. In approaches, the lubricating compositions may include about 0.3 to about 4 weight percent of the antioxidants described herein, and in other approaches, about 0.5 to about 3 weight percent of the antioxidants (or other ranges therein).

Suitable antioxidants include phenolic antioxidants, aromatic amine antioxidants, sulfur containing antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylamino diphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

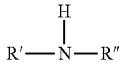

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups. The aryl group may be substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. In approaches, one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyl-diphenylamine, dinonyldiphenylamine, monotetradecyldiphenylamine, ditetradecyl-diphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldi-phenylamine, and mixed octylstyryldiphenylamine.

Sulfur containing antioxidants may include, but are not limited to, sulfurized olefins that are characterized by the type of olefin used in their production and the final sulfur content of the antioxidant. High molecular weight olefins, such as those olefins having an average molecular weight of 168 to 351 g/mole, may be preferred if used in the systems herein. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene. Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating compositions herein may be present in an amount to deliver up to about 400 ppm nitrogen, or up to about 300 ppm nitrogen, or up to about 200 ppm nitrogen, or about 100 to about 400 ppm nitrogen so long as the nitrogen provided by the antioxidant system also meets the other parameters noted above, such as the relationship of a weight ratio of nitrogen provided by the at least one antioxidant to the total nitrogen in the lubricant composition of about 0.15:1 to about 0.4:1, and in yet other approaches, about 0.16:1 to about 0.36:1, or in further approaches, about 0.18:1 to about 0.32:1 evidencing an AES of about 7 or higher, or about 8 or higher. In further approaches, the lubricant compositions herein also have a weight ratio of nitrogen provided by the dispersant system to nitrogen provided by the at least one antioxidant is controlled within a ratio of about 1.8:1 to about 5.3:1, or in other approaches, about 1.82:1 to about 5.27:1, and in yet other approaches, about 2.4:1 to about 4.7:1 to aid in achieving AES values of about 7 or higher, or about 8 or higher. As also shown in FIGS. 2 and 4 such relationships also surprisingly show a minimum and maximum effects with sludge control pursuant to the M271 EVO testing.

The lubricant composition may further include an optional detergent system with one or more neutral, low-based, or overbased detergents, or mixtures thereof. In approaches, the detergents may provide up to about 3500 ppm metal and may have a combined total TBN of about 0 to about 150 in the fluids. Suitable detergent substrates include phenates, sulfur-containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, zinc, or mixtures thereof. In one approach, the detergent may be salted with magnesium A suitable detergent may include alkali or alkaline earth metal salts, e.g., calcium or magnesium, of petroleum sulfonic acids and long chain mono- or di-alkylaryl sulfonic acids with the aryl group being benzyl, tolyl, and xylyl. Examples of other suitable detergents include, but are not limited to low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols. In one approach, the detergent is magnesium sulfonate.

The detergent may be present at about 0 wt % to about 10 wt %, or about 0.1 wt % to about 8 wt %, or about 1 wt % to about 4 wt %, or about 1 wt % to about 2 wt %, or about 0.5 to about 4 weight percent, or even about 0.75 to about 3 weight percent. In other approaches, the detergent may be provided in the lubricating oil composition in an amount to provide about 450 to about 2200 ppm metal to the lubricant composition and to deliver a soap content of about 0.4 to about 1.5 weight percent to the lubricant composition. In other approaches, the detergent is in an amount to provide about 450 to about 2200 ppm metal to the lubricant composition and to deliver a soap content of about 0.4 to about 0.7 weight percent to the lubricant composition.

Overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may comprise at least 30 wt % to about 70 weight percent of the total detergent in the lubricating oil composition. In other approaches, the low-based/neutral detergent may comprise about 30 to about 70 wt % of the total detergent in the lubricating oil composition. In approaches, the detergent system may be a combination of neutral and overbased detergents including overbased calcium sulfonates and more neutral magnesium sulfonates providing about 200 ppm to about 3500 ppm calcium and about 300 ppm to about 2000 ppm magnesium to the composition.

The low-based/neutral detergent has a TBN of up to 175 mg KOH/g, or up to 150 mg KOH/g. The low-based/neutral detergent may include a calcium or magnesium-containing detergent. Examples of suitable low-based/neutral detergent include, but are not limited to, calcium sulfonates, calcium phenates, calcium salicylates, magnesium sulfonates, magnesium phenates, and magnesium salicylates. In some embodiments, the low-based/neutral detergent is a mixture of calcium-containing detergents and or magnesium-containing detergents.

In certain embodiments, one or more low-based/neutral detergents provide from about 50 to about 1000 ppm magnesium by weight to the lubricating oil composition based on a total weight of the lubricating oil composition and an overbased detergents may provide about 1000 to about 2000 ppm calcium to the lubricating compositions herein. In some embodiments, the one or more low-based/neutral calcium-containing detergents provide from 75 to less than 800 ppm, or from 100 to 600 ppm, or from 125 to 500 ppm by weight calcium or magnesium to the lubricant composition based on a total weight of the lubricant composition.

Lubricating Oil Compositions

The dispersant system, antioxidant system, optional anti-wear systems, and optional detergent systems described above may be combined with a major amount of a base oil blend or base oil blend of lubricating viscosity (as described below) in combination with one or more further optional additives to produce a lubricating oil composition. In approaches, the lubricating oil compositions includes about 50 weight percent or more of the base oil blend, about 60 weight percent or more, about 70 weight percent or more, or about 80 weight percent or more to about 95 weight percent or less, about 90 weight percent or less, about 85 weight percent or less of the base oil blend as such blend is further discussed below.

Base Oil Blend: The base oil used in the lubricating oil compositions herein may be oils of lubricating viscosity and selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as α-olefins, and mixtures thereof, alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Optional Additives:

The lubricating oil compositions herein may also include a number of optional additives combined with the dispersant system, antioxidant system, and antiwear system discussed above as needed to meet performance standards so long as the noted relationships for nitrogen and nitrogen source are maintained. Those optional additives are described in the following paragraphs.

Optional Dispersants: The lubricating oil composition may optionally include one or more additional dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

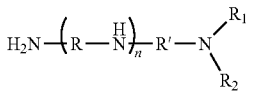

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The optional dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Additional Antioxidants: The lubricating oil compositions herein also may optionally contain one or more further antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as $\alpha$-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2):(0 to 2):(0 to 1).

The one or more antioxidant(s) may be present in ranges about 0 wt % to about 20 wt %, or about 0.1 wt % to about 10 wt %, or about 1 wt % to about 5 wt %, of the lubricating oil composition.

Further Antiwear Agents: The lubricating oil compositions herein also may optionally contain one or more further antiwear agents. Examples of suitable additional antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds: The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Additional Detergents: The lubricating oil composition may optionally further comprise one or more additional neutral, low based, or overbased detergents, and mixtures thereof. Suitable additional detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a diester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-containing component: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ 5-165, S-200, S-300, 5-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

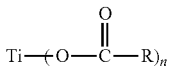

wherein n is an integer selected from 2, 3 and 4, and R is a hydrocarbyl group containing from about 5 to about 24 carbon atoms, or by the formula:

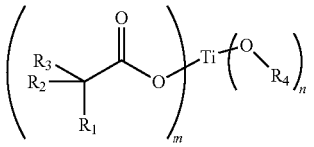

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

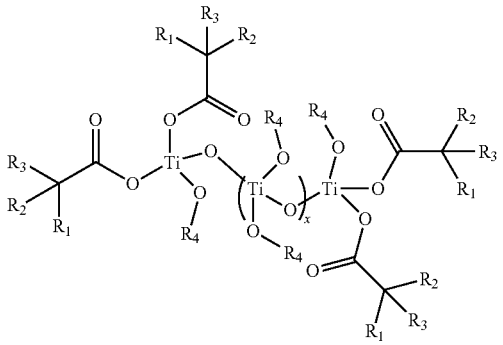

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the neutral to overbased and sulfurized alkyl phenate product herein may include additive components in the ranges listed in the following table.

TABLE 2

Suitable Lubricating Compositions

| Component | Wt. % (Suitable Embodiments) | Wt. % (Suitable Embodiments) |
|---|---|---|
| Succinimide Dispersant(s) | 1.0-8.0 | 2.5-5.5 |
| Antioxidant(s) | 0.3-4.0 | 0.5-3.0 |
| Detergent(s) | 0.5-4.0 | 0.75-3.0 |
| Antiwear (ZDDP) | 0.1-2.0 | 0.5-1.5 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.0-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Lubricants herein are configured for use in various types of lubricants, such as automotive lubricants and/or greases, internal combustion engine oils, hybrid engine oils, electric engine lubricants, drivetrain lubricants, transmission lubricants, gear oils, hydraulic lubricants, tractor hydraulic fluids, metal working fluids, turbine engine lubricants, stationary engine lubricants, tractor lubricants, motorcycle lubricants, power steering fluids, clutch fluids, axles fluids, wet break fluids, and the like. Suitable engine types may include, but are not limited to heavy-duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression-ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Engines may be coupled with a turbocharger.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment, the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

Further, lubricants of the present description may be suitable to meet one or more industry specification requirements such as ILSAC GF-3, GF-4, GF-5, GF-6, PC-11, CF, CF-4, CH-4, CK-4, FA-4, CJ-4, CI-4 Plus, CI-4, API SG, SJ, SL, SM, SN, SN PLUS, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos1™, Dexos2™, MB-Approval 229.1, 229.3, 229.5, 229.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+, Porsche A40, C30, Peugeot Citroën Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122 or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

In one embodiment, the lubricating oil composition is an engine oil, wherein the lubricating oil composition may have (i) a sulfur content of about 0.5 wt % or less, (ii) a phosphorus content of about 0.1 wt % or less, and (iii) a sulfated ash content of about 1.5 wt % or less.

In one embodiment, the lubricating oil composition is suitable for a 2-stroke or a 4-stroke marine diesel internal combustion engine. In one embodiment, the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

Lubricating compositions were prepared as shown in Tables 3 and 4. Table 5 shows the impact on average engine sludge (AES) pursuant to the M271 EVO fired engine test (CEC L-107-19). Each of the fluids, whether inventive or comparative, for these evaluations included the following:

- Disp1 is a polyisobutylene succinimide dispersant wherein the polyisobutylene substituent has a molecular weight greater than 1900;
- Disp2 is a polyisobutylene succinimide dispersant wherein the polyisobutylene substituent has a molecular weight less than 1900;
- Disp3 is a polyisobutylene succinimide dispersant post-reacted with maleic anhydride and boric acid;
- AO1 is an alkylated diphenyl amine antioxidant;
- AO2 is a hindered phenolic antioxidant;

The fluids also included comparable amounts of ZDDP, calcium and magnesium sulfonate detergents, antifoam, diluents, friction modifiers, pour point dispersants, viscosity modifiers, and a base oil blend to target a KV100 of about 10.5 cSt. The fluids had a TBN of about 7.1 to about 8.7 mgKOH/g.

TABLE 3

| | | Dispersant (wt %) | | | Antioxidant (wt %) | |
|---|---|---|---|---|---|---|
| Fluid | | Disp1 | Disp2 | Disp3 | AO1 | AO2 |
| A | Inventive | 4.65 | 0.52 | 0 | 0.84 | 0.82 |
| B | Inventive | 4.65 | 0 | 1.33 | 0.59 | 1.58 |
| C | Inventive | 3.8 | 2.19 | 0 | 0.5 | 1.88 |
| D | Inventive | 4.57 | 0.87 | 0 | 0.94 | 1.14 |

TABLE 3-continued

| Fluid | | Dispersant (wt %) | | | Antioxidant (wt %) | |
|---|---|---|---|---|---|---|
| | | Disp1 | Disp2 | Disp3 | AO1 | AO2 |
| E | Inventive | 3.84 | 0 | 1.03 | 0.74 | 1.25 |
| F | Inventive | 3.43 | 2.21 | 0 | 0.63 | 0.5 |
| G | Comparative | 3.43 | 0 | 1.48 | 0.34 | 0.68 |
| H | Comparative | 3.31 | 0 | 1.5 | 1.71 | 0.36 |

TABLE 4

| Fluid | Disp N% | AO N% | Total N% | Post-Reacted N% | Non-Post-Reacted N% | Disp N:tot N | AO N:tot N | Non-Post-Reacted N%:Disp N | Disp N: AO N |
|---|---|---|---|---|---|---|---|---|---|
| A | 0.075 | 0.032 | 0.110 | — | 0.075 | 0.68 | 0.29 | 1.00 | 2.35 |
| B | 0.091 | 0.022 | 0.116 | 0.020 | 0.0670 | 0.78 | 0.19 | 0.77 | 4.04 |
| C | 0.080 | 0.019 | 0.102 | — | 0.081 | 0.79 | 0.19 | 1.00 | 4.21 |
| D | 0.078 | 0.036 | 0.116 | — | 0.078 | 0.67 | 0.31 | 1.00 | 2.17 |
| E | 0.074 | 0.028 | 0.105 | 0.016 | 0.058 | 0.70 | 0.27 | 0.78 | 2.62 |
| F | 0.075 | 0.024 | 0.101 | — | 0.076 | 0.74 | 0.24 | 1.00 | 3.11 |
| G | 0.075 | 0.013 | 0.090 | 0.023 | 0.052 | 0.83 | 0.14 | 0.69 | 5.78 |
| H | 0.073 | 0.065 | 0.141 | 0.024 | 0.050 | 0.52 | 0.46 | 0.68 | 1.12 |

TABLE 5

| Average Engine Sludge (CEC L-107-19) | |
|---|---|
| Fluid | AES |
| A | 8.9 |
| B | 8.7 |
| C | 8.6 |
| D | 8.5 |
| E | 8.1 |
| F | 8.0 |
| G | 5.8 |
| H | 4.6 |

As shown in Tables 3, 4, and 5, while comparative fluids G and H had similar ingredients as the inventive samples, comparative fluids G and H did not meet one or more relationships with respect to total nitrogen or source of nitrogen in the fluids and such lubricants suffered with respect to the average engine sludge pursuant to the M271 fired engine testing. On the other hand, inventive fluids A to F all satisfied the unique fluid parameters relating to nitrogen and nitrogen sources and surprisingly exhibited almost double the AES performance on the M271 fired engine testing. FIGS. 1 to 4 also show the AES achieved relative to the nitrogen and origin of the nitrogen from the inventive and comparative fluids showing the unique minimum and maximum effects of the compositions herein.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricant composition effective to reduce engine sludge, the lubricant composition comprising a base oil of lubricating viscosity;

nitrogen provided by a dispersant system and an antioxidant system;

about 1 to about 8 weight percent of the dispersant system including a first hydrocarbyl substituted succinimide dispersant obtainable by reacting a hydrocarbyl substituted acylating agent with a nitrogen source wherein the hydrocarbyl substituent of the first dispersant has a number average molecular weight of at least about 1900 and a second hydrocarbyl substituted succinimide dispersant obtainable by reacting a hydrocarbyl substituted acylating agent with a nitrogen source wherein the hydrocarbyl substituent of the second dispersant has a number average molecular weight less than 1900;

about 0.3 to about 4 weight percent of the antioxidant system including at least an alkylated diphenyl aminic antioxidant and a hindered phenolic antioxidant;

a weight ratio of nitrogen provided by the dispersant system to total nitrogen in the lubricant composition of about 0.6:1 to about 0.8:1;

at least about 75% of the nitrogen provided by the dispersant system is a primary or secondary nitrogen and not post-reacted;

a weight ratio of nitrogen provided by the aminic antioxidant of the antioxidant system to the total nitrogen in the lubricant composition of about 0.15:1 to about 0.4:1 a weight ratio of nitrogen provided by the dispersant system to nitrogen provided by the aminic antioxidant of about 1.8:1 to about 5.3:1; and wherein the lubricant composition exhibits an average engine sludge of about 7 to about 10 merits pursuant to CEC L-107-19.

2. The lubricant composition of claim 1, further including a phosphorus source including one or more phosphorus-containing compounds independently selected from a thiophosphate, a dithiophosphate, a metal phosphate, a metal thiophosphate, a metal di-thiophosphate, a phosphate, a phosphite, a phosphonate, salts thereof, and mixtures thereof.

3. The lubricant composition of claim 1, further including a detergent system including at least one metal containing detergent providing up to about 3500 ppm metal to the composition and having a combined total base number of 0 to about 500.

4. The lubricant composition of claim 1, wherein each of the hydrocarbyl substituted succinimide dispersants of the dispersant system has a structure of Formula I:

(Formula I)

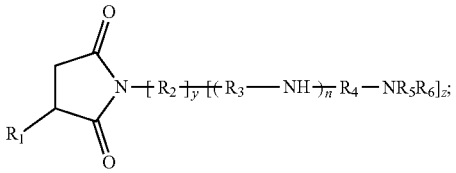

wherein $R_1$ of the first dispersant is a hydrocarbyl group having a number average molecular weight of about 1900 to about 5,000 and $R_1$ of the second dispersant is a hydrocarbyl group having a number average molecular weight of about 350 to about 1900;

$R_2$, $R_3$, and $R_4$ are independently divalent $C_1$-$C_6$ moieties;

each of $R_5$ and $R_6$, independently, is hydrogen, a $C_1$-$C_6$ alkyl group, or together with the nitrogen to which they are attached form a 5- or 6-membered ring optionally fused with one or more aromatic or non-aromatic rings;

n is an integer from 0 to 8; and y and z are each integers and wherein y+z=1.

5. The lubricant composition of claim 4, wherein $R_5$ and $R_6$ together with the nitrogen to which they are attached form a radical of Formula II (Formula II)

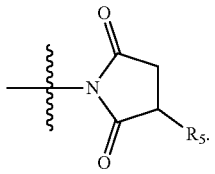

6. The lubricant composition of claim 1, wherein the hydrocarbyl substituted acylating agent is maleic anhydride; and the nitrogen source is a polyalkylene polyamine selected from a mixture of polyethylene polyamines having an average of 5 nitrogen atoms, diethylene triamine, triethylene tetramine, tetraethylene pentamine, pentaethylene hexamine, or combinations thereof.

7. The lubricant composition of claim 6, wherein only one of the hydrocarbyl substituted succinimide dispersants is post-treated with a boron source and/or maleic anhydride.

8. The lubricant composition of claim 7, wherein the dispersant system includes about 2 to about 4 times more of the non-post treated dispersant than the post-treated dispersant.

9. The lubricant composition of claim 7, wherein the dispersant systems provides no more than about 300 ppm of total boron to the lubricant composition.

10. The lubricant composition of claim 2, wherein the phosphorus source is present in an amount to provide about up to about 900 ppm of phosphorus to the lubricating composition.

11. The lubricant composition of claim 2, wherein the one or more phosphorus-containing compounds is independently selected from a metal phosphate, a metal thiophosphate, a metal dithiophosphate, or combinations thereof.

12. The lubricant composition of claim 11, wherein the one or more phosphorus-containing compounds is a metal dithiophosphate and includes 12 to 32 total carbon atoms within alkyl groups thereon, wherein each of the alkyl groups independently averages 3 to 8 carbon atoms.

13. The lubricant composition of claim 11, wherein the one or more phosphorus-containing compounds include a first metal dithiophosphate with the alkyl groups derived from secondary alcohols and a second metal dithiophosphate with the alkyl groups derived from primary alcohols.

14. The lubricant composition of claim 11, wherein the metal of the one or more phosphorus-containing compounds is independently selected from the group consisting of aluminum, lead, tin, molybdenum, manganese, nickel, copper, titanium, tungsten, zirconium, or zinc.

15. The lubricant composition of claim 3, wherein the detergent systems include one or more metal containing phenates, sulfur-containing phenates, sulfonates, calixarates, salixarates, salicylates, carboxylic acids, phosphorus acids, mono- and/or di-thiophosphoric acids, alkyl phenols, sulfur coupled alkyl phenol compounds, methylene bridged phenols, or combinations thereof.

* * * * *